US010173259B2

(12) United States Patent
Calvo Poza et al.

(10) Patent No.: US 10,173,259 B2
(45) Date of Patent: Jan. 8, 2019

(54) MACHINE FOR PRODUCING SAND MOULDS

(71) Applicant: LORAMENDI, S. COOP., Vitoria (ES)

(72) Inventors: Francisco Calvo Poza, Vitoria (ES); Gonzalo Ocio Iglesias, Vitoria (ES); Ignacio Echevarria Castaño, Vitoria (ES); Ander Eguidazu Aldalur, Vitoria (ES); Cesar Marco Serrano, Vitoria (ES)

( * ) Notice: Subject to any disclaimer, the term of this patent is extended or adjusted under 35 U.S.C. 154(b) by 261 days.

(21) Appl. No.: 14/893,238

(22) PCT Filed: May 7, 2014

(86) PCT No.: PCT/EP2014/059380
§ 371 (c)(1),
(2) Date: Nov. 23, 2015

(87) PCT Pub. No.: WO2014/187671
PCT Pub. Date: Nov. 27, 2014

(65) Prior Publication Data

US 2016/0089713 A1 Mar. 31, 2016

(30) Foreign Application Priority Data

May 21, 2013 (EP) ..... 13382188

(51) Int. Cl.
*B22C 17/00* (2006.01)
*B22C 11/10* (2006.01)
(Continued)

(52) U.S. Cl.
CPC ..... *B22C 17/00* (2013.01); *B22C 7/04* (2013.01); *B22C 9/02* (2013.01); *B22C 11/10* (2013.01); *B22C 15/02* (2013.01); *B22C 25/00* (2013.01)

(58) Field of Classification Search
CPC .. B22C 17/00; B22C 7/04; B22C 9/02; B22C 11/10; B22C 15/02; B22C 25/00
See application file for complete search history.

(56) References Cited

U.S. PATENT DOCUMENTS 4,409,718 A 10/1983 Pryor
4,541,476 A 9/1985 Larsen
(Continued)

FOREIGN PATENT DOCUMENTS

CN 102166624 8/2011
CN 102451891 5/2012
(Continued)

OTHER PUBLICATIONS

English machine translation of JP-63-281748.*

*Primary Examiner* — Kevin P Kerns
*Assistant Examiner* — Steven S Ha
(74) *Attorney, Agent, or Firm* — Eugenio J. Torres-Oyola; Victor M. Rodriguez-Reyes; Ferraiuoli LLC

(57) ABSTRACT

Machine for the production of sand molds comprising a machine structure with a molding chamber (3), a front plate (1) and a rear plate (2). The front plate (2) and rear plate (3) are arranged for pressing sand within said molding chamber so as to form a sand mold, and are arranged for receiving respective pattern plates (200) for providing front and rear surfaces of the sand mold with corresponding patterns. The machine further comprises a robot arm (6) arranged for replacing the pattern plates (200), said robot arm being (6) attached to the machine structure, such as to a side (101) of the machine structure.

9 Claims, 6 Drawing Sheets

(51) Int. Cl.

| | |
|---|---|
| ***B22C 15/02*** | (2006.01) |
| ***B22C 25/00*** | (2006.01) |
| ***B22C 7/04*** | (2006.01) |
| ***B22C 9/02*** | (2006.01) |

(56) References Cited

U.S. PATENT DOCUMENTS

| | | | |
|---|---|---|---|
| 4,721,148 | A | 1/1988 | Knudsen |
| 4,765,389 | A | 8/1988 | Knudsen |
| 7,757,744 | B2 | 7/2010 | Hirata |
| 7,806,161 | B2 | 10/2010 | Jezwinski |
| 8,956,148 | B2 | 1/2015 | Calvo Poza |

FOREIGN PATENT DOCUMENTS

| | | | | |
|---|---|---|---|---|
| EP | 0059551 | B1 | | 4/1985 |
| JP | 63281748 | A | * | 11/1988 |
| RU | 72816 | U1 | | 5/2008 |
| SU | 1346321 | A1 | | 10/1987 |

* cited by examiner

MACHINE FOR PRODUCING SAND MOULDS

CROSS-REFERENCE TO RELATED APPLICATIONS

This application claims priority from International Application No. PCT/EP2014/059380 filed on May 7, 2014, which claims priority from European Application No. EP13382188.4, filed May 21, 2013.

FIELD OF THE INVENTION

The invention is related to the field of machines for the production of sand moulds or sand mould parts.

BACKGROUND OF THE INVENTION

Metal casting is often performed using sand moulds which are produced in machines that produce sand moulds or sand mould parts which are placed in a string one after the other, and transported to a pouring station where the space between these moulds or mould parts is filled with metal. These machines often include core setters to insert cores between the moulds or mould parts.

These mould producing machines typically comprise a generally rectangular moulding chamber in which the sand is introduced (for example, by blowing or by gravity), through a hopper or bell arranged above the moulding chamber. Said chamber is closed by means of two closing elements or plates, such as a front plate and a rear plate, between which the sand is pressed to configure the mould or mould part. For example, one of said plates can be a mobile and swivelling front plate arranged allow the exit of the mould or mould part, and the rear plate can be arranged at the opposite end of the chamber and be associated with a compaction piston, which also serves to perform the pushing and corresponding expulsion of the mould through the front end of the chamber. In this kind of machine, the obtaining of the mould can start with the introduction of the sand in the moulding chamber. Next, in a compression phase of the moulding cycle, the sand is pressed between the front and rear plate. Then, in what can be called the extraction phase of the moulding cycle, the front plate is opened and tilted to allow the exit of the mould, which is achieved by means of the push of the rear plate, thus causing the extraction of the mould from the moulding chamber. Machines of this type are described in, for example, U.S. Pat. Nos. 7,007,738 and 6,092,585. These patents describe vertical mould moulding machines comprising a moulding chamber which is closed by means of a shiftable and swiveling front plate and a rear plate provided at an end of an extraction piston, the sand mould being compacted by the opposing pressure of the two plates. In this way, moulds are obtained cyclically, and expelled from the moulding chamber, aligned and placed against one another forming a string which can be transferred towards the pouring station, etc. Other examples of vertical mould forming machines are described in U.S. Pat. No. 4,442,882, EP-A-1101548, WO-A-01/12360, EP-A-1219830, U.S. Pat. No. 7,806,161 and EP-A-2357050.

Generally, the front and the rear plates are provided with pattern plates, as explained in, for example, U.S. Pat. No. 7,806,161, said pattern plates being selected in accordance with the pattern or shape to be given to the front and rear surfaces of the mould. Thus, when the machine is to be used to produce moulds differing from the previously produced moulds, the pattern plates have to be changed. The pattern plates can be attached to the front and rear plates, also known as squeeze heads or squeeze head plates, using any suitable means. The change of pattern plates generally involves removing the previously used pattern plates from the front and rear plates, respectively, and connecting the new pattern plates to the front and rear plates, respectively. This operation has conventionally been performed manually. As the pattern plates can be rather heavy, sometimes the operator has used some kind of lifting device.

SUMMARY OF THE INVENTION

Although lift aids can be helpful for the operator, replacing pattern plates can still involve some difficulties for the operator, and the risks that are always involved with the manipulation of heavy objects. Also, as the pattern plates have to be applied to the surfaces of the front and rear plates that face the inside of the moulding chamber, the operator has to access an area which sometimes is difficult to access, and in which access can be risky should the safety mechanisms of the machine fail. Thus, it has been considered that it is desirable to reduce the need for human intervention in relation to the change of pattern plates.

One solution might be to use a robot or manipulator placed on the floor next to the machine and arranged to transfer the pattern plates between a pattern plate storage means, such as a wagon or carriage with means for storing pattern plates, from which the new pattern plates can be taken and to which the previously used pattern plates can be transferred. However, this robot would take up floor space and could constitute an obstacle for operators working in the surroundings of the machine, for example, during production of moulds or during maintenance. The presence of this kind of robot could also make cleaning operations, such as cleaning of a factory floor, more cumbersome.

A first aspect of the invention relates to a machine for the production of sand moulds comprising a machine structure, which can include, for example, a framework and/or an enclosure, such an enclosure including, for example, a roof and a side wall. The machine structure includes a moulding chamber, a front plate and a rear plate, said front plate and rear plate being arranged for pressing sand within said moulding chamber so as to form a sand mould, said front plate and rear plate being arranged for receiving respective pattern plates for providing front and rear surfaces of the sand mould with corresponding patterns. The machine structure can further comprise, for example, feed means for feeding sand to the moulding chamber.

In accordance with this aspect of the invention, the machine further comprises a robot arm arranged for replacing the pattern plates, said robot arm being attached to the machine structure, such as to a framework and/or enclosure of the machine structure. For example, the robot arm can be attached to a side of the machine structure or to a top portion of the machine structure such as to a roof of the machine or its enclosure, or to beams of the framework of the machine, such as lateral beams or horizontal beams in the upper part of the machine structure. Preferably, the robot arm is attached to a side of the machine structure, such as a side of the framework and/or enclosure of the machine.

By using a robot arm, the need for human intervention is reduced, and by attaching the robot arm to a side of the machine or machine structure, a compact machine design is achieved, without any robot occupying floor space and restricting movement in the surroundings of the machine. A further advantage with this solution is that installation of the machine at the premises of a customer can be simplified, as the robot arm for exchanging the pattern plates is part of the machine and attached to the machine structure, so that it is not necessary to carry out, for example, substantial civil engineering or similar at the premises of the customer, in addition to what is needed to install the machine as such. This reduces the time needed to install a machine ready to operate, and also the costs involved. Also, the fact that the robot arm is attached to the machine structure implies that it is always placed in a correct position for access to the moulding chamber, and that it will reach the positions necessary to change the pattern plates. That is, the correct positioning depends on the designer and manufacturer of the machine, and not on third parties in charge of carrying out the installation of the system at the premises of the customer.

In some embodiments of the invention, the robot arm is attached to the machine structure above the floor, so that no part of the robot arm is in contact with the floor. Thereby, tasks such as the cleaning of the floor are not made more difficult due to the presence of a robot or similar on the floor. This is important, as during operation of this kind of machine it is almost inevitable that sand accumulates on the floor. Also, conventionally there are already many auxiliary devices placed on the floor close to this kind of machines. Thus, not placing a further device on the floor can be an important advantage. Also, by having the robot arm attached to the machine so as not to be in contact with the floor, any relative movements between the machine and the floor, for example, due to vibrations or similar, will not subject the robot arm to forces that can damage it or influence its position or orientation in relation to the front and rear plates of the machine. This is important, as the robot arm has to be able to correctly position the pattern plates in relation to the front and rear plates of the machine.

In some embodiments of the invention, the robot arm comprises vertical drive means for displacing the robot arm vertically, and three pivot joints for pivoting three corresponding arm segments of the rotor arm around corresponding vertical axes. That is, a simple SCARA-type robot arm can be used. It has been found that this kind of robot arm, with arm segments arranged to pivot in horizontal planes, about corresponding joints, and with the possibility of movement in the vertical direction, can be enough to carry out the replacement of pattern plates. Especially, there is no need for any tilting operations. Thus, this kind of vertically displaceable system, with three arm segments that are pivotally arranged in their respective horizontal planes, and with the arm or at least one of its segments being moveable in the vertical direction, is a cost-efficient alternative to the more complex industrial robots, such as robots with six degrees of freedom.

In some embodiments of the invention, the robot arm comprises an electric motor for driving the robot arm vertically, and three electric motors each arranged for driving a corresponding one of said three arm segments to pivot with respect to the corresponding pivot joint. For example, the robot arm can have a proximal end at which it is attached to the machine structure, and a distal end which is provided with means for retaining a pattern plate, and said pivot joints can comprise a proximal joint, an intermediate joint and a distal joint, said distal joint being arranged for pivoting a distal arm segment with respect to an intermediate arm segment. In these embodiments, the electric motor arranged for operating said distal joint can be placed away from said distal joint, and the robot arm can comprise drive means placed within said intermediate arm segment so that said electric motor arranged for operating said distal joint can operate said distal joint through said intermediate arm segment, to pivot said distal arm segment. From a constructional point of view it may be simpler to place the electric motor for driving said distal arm segment upon the distal joint, but as at least the distal arm segment will have to be introduced into the moulding chamber to carry out the change of the pattern plates, it can be preferred to have the electric motor placed away from said distal joint, that is, placed somewhere along the arm in the direction towards the proximal end of the arm.

In some embodiments of the invention, the electric motor for operating said distal joint is placed in correspondence with said intermediate joint, for example, on top of said intermediate joint. This is a practical solution, according to which the electric motor can operate the distal joint through drive means, such as a chain, belt or a drive shaft, placed within said intermediate arm segment.

In some embodiments of the invention, said electric motor for operating said distal joint is arranged for operating said distal joint by means of at least one of a chain, a belt and a drive shaft extending throughout said intermediate arm segment.

The machine can further comprise electronic means for programming the robot arm and/or for controlling the movement of the robot arm, so as to cause said robot arm to carry out the movements necessary for changing pattern plates.

Another aspect of the invention relates to a method of replacing pattern plates in a machine as described above, comprising the step of using the robot arm for replacing pattern plates.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

DETAILED DESCRIPTION OF THE PREFERRED EMBODIMENT

Figure 1:
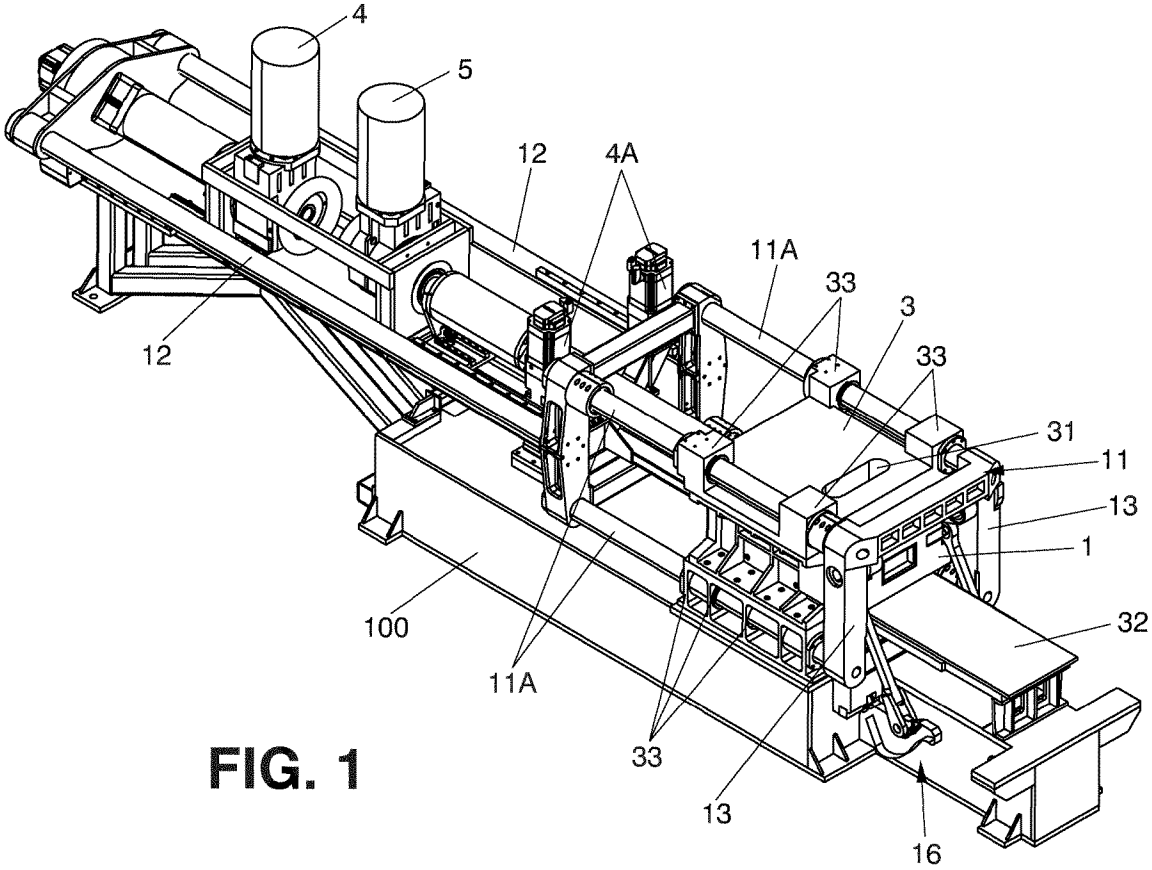
FIG. 1 is a perspective view of part of the mechanism of a machine in accordance with one possible embodiment of the invention.

FIG. 1 schematically illustrates the mechanism of a machine in accordance with one possible embodiment of the invention. This mechanism is disclosed in more detail in EP-A-2357050, and will thus just be briefly explained herein.

FIG. 1 shows how on a general frame 100 there is assembled a structure of a moulding chamber 3, with an inlet opening 31 through which the sand (or the like) can be introduced in the chamber by blowing, through a hopper or bell (not shown), as is conventional in the art. The machine comprises a floor part 32 forming the floor of the moulding chamber and extending towards the outside through the front end of the moulding chamber, forming a floor or support on which the moulds or mould parts can be slid during the extraction phase, towards a receiver (not shown) which can be a conveyor belt, or the like, as is conventional in the art.

Figure 2:
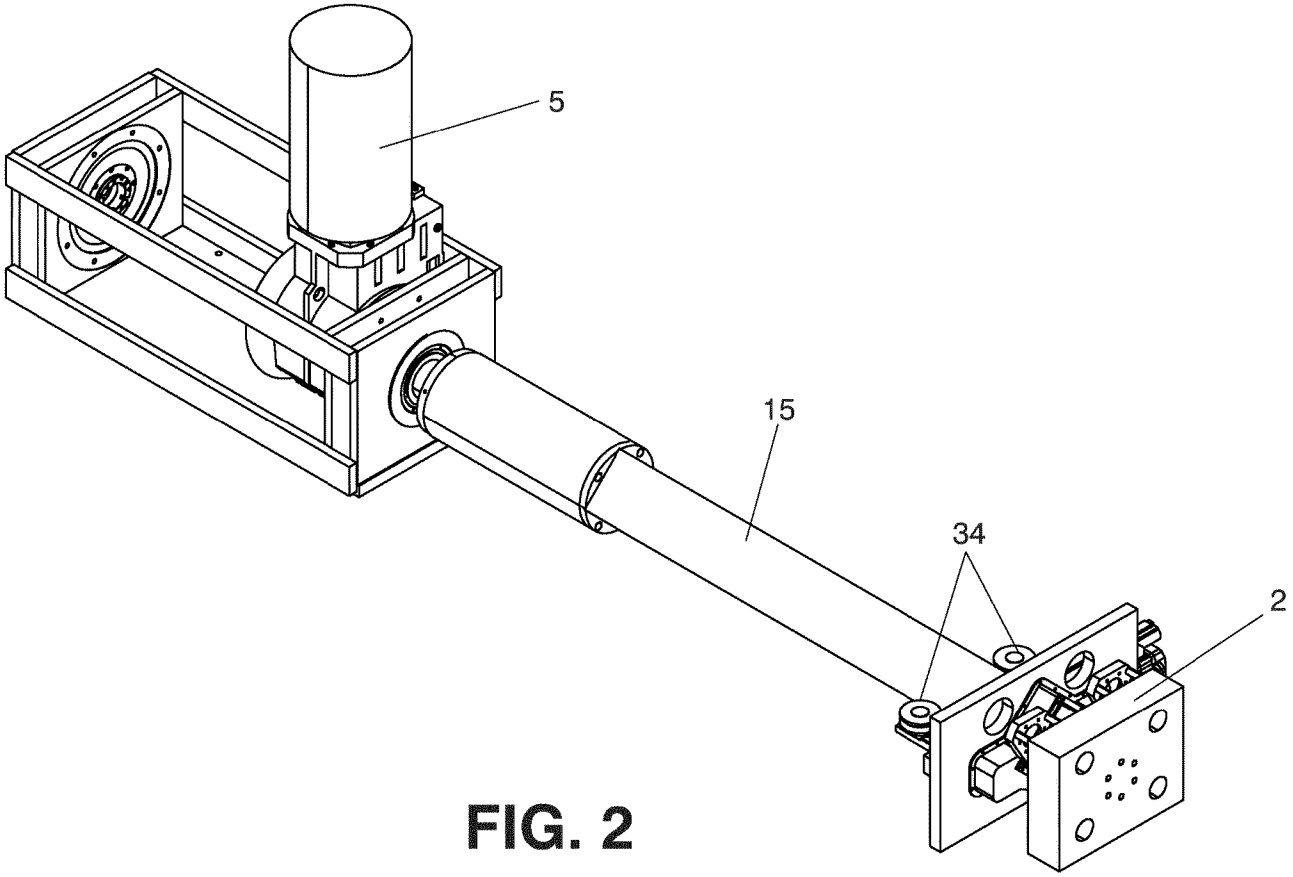
FIG. 2 is a perspective view of some components of said mechanism.

The machine also comprises a front plate 1 (pivotally mounted in a frame 13) located in correspondence with the front end of the moulding chamber 3, and a rear plate 2, shown in FIG. 2, located in correspondence with the rear end of the moulding chamber 3. These plates are arranged to perform a cyclic movement between two end positions, to perform a moulding cycle with a compression phase (in which the material in the moulding cavity is compressed between the front plate 1 and the rear plate 2), and an extraction phase in which the front plate 1 shifts away from the moulding chamber 3 swivelling upwards, as known in the art, allowing the rear plate 2 to push the mould or mould part out of the chamber 3. The swivelling can be performed with a cam mechanism 16 shown schematically in FIG. 1 and which can comprise an electromechanical system or even a mechanical system, as described in, for example, EP-A-1219830. Alternatively, the swiveling can be performed by a motor, for example, by an electric motor specifically intended to swivel the front plate 1.

In accordance with this specific embodiment of the invention, the front plate 1 is coupled in a swivelling manner to a frame 11 which is arranged to be displaced in the longitudinal direction of the machine. In this embodiment, the frame 11 comprises a plurality of bars 11A which can slide axially, guided by guides 33 associated with the moulding chamber 3, and which guide the frame in its back and forth movement between its two end positions, a movement which is repeated for every moulding cycle. The frame 11 is connected to two bars 12 extending in the longitudinal direction of the machine and on which electric motors 4 and 4A can act. On the other hand, the rear plate 2 is assembled at the end of an element 15 in the form of a rod or bar which is moveable in the longitudinal direction of the machine, guided by rollers 34 located just behind the moulding chamber 3, and optionally by additional guiding elements. The rear plate can be displaced by an electric motor 5.

The movement of the front plate 1 and rear plate 2 between the end positions thereof can be similar to that which is disclosed in, for example, EP-A-1219830. The reference to electric motors is just by way of example, and any other drive means can be used, for example, hydraulic drive means, as known in the art.

Figure 3:
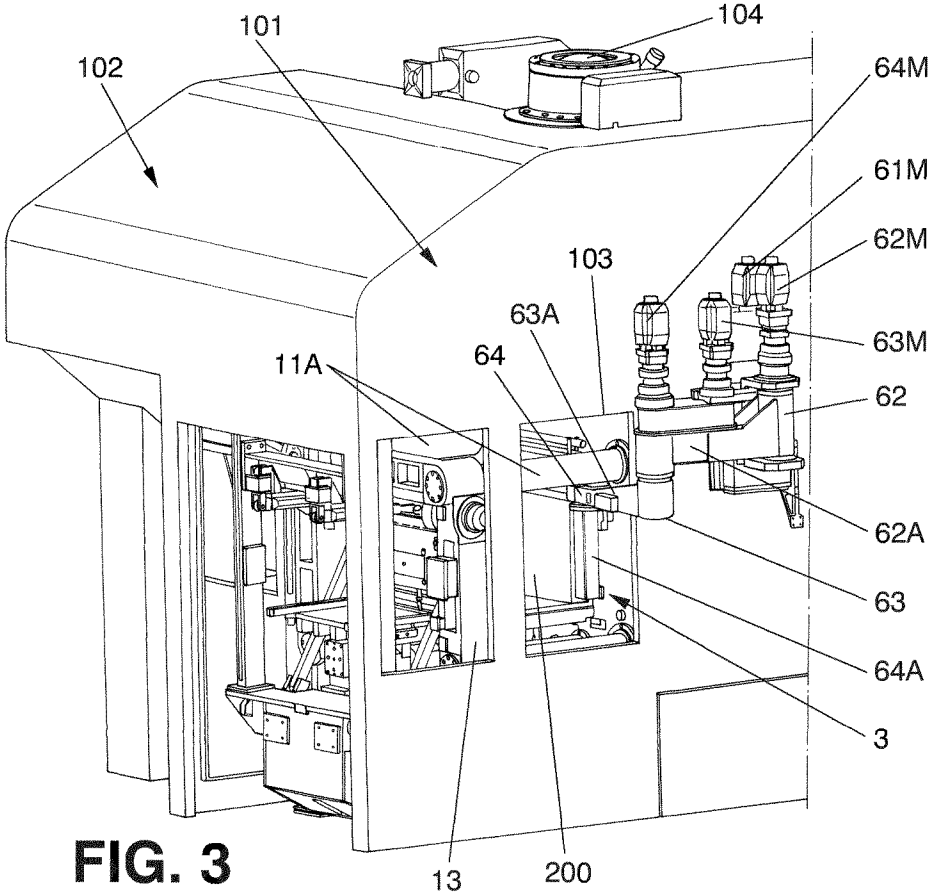
FIGS. 3 and 4 are perspective views of a machine in accordance with an embodiment of the invention.
Figure 4:
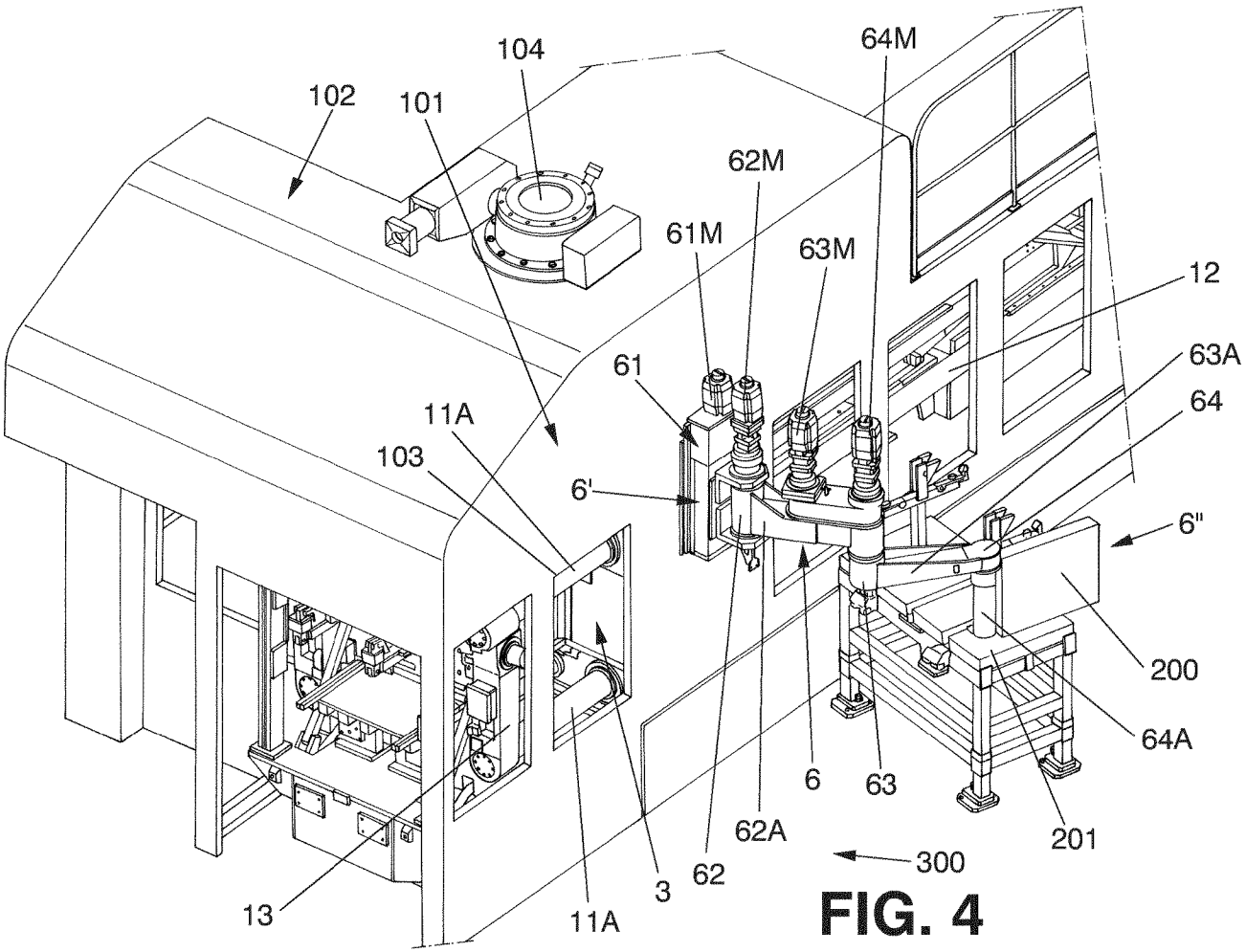

FIGS. 3 and 4 schematically illustrate a machine according to an embodiment of the invention, comprising a mechanism such as, for example, illustrated in FIGS. 1 and 2, or any other suitable mechanism for producing moulds or mould parts using front and rear press plates to which pattern plates are attached, said pattern plates being removable so as to allow the pattern to be changed. The machine structure comprises a housing with roof 102 and side walls 101, and at least one of the side walls features at least one opening 103 for access to the moulding chamber. Part of the system 104 for introduction of sand into the moulding chamber 3 can be observed in FIGS. 3 and 4. Also, in FIGS. 3 and 4, the frame 13 for the front plate can be observed, as well as the frame 11 and the bars 12 that have been described in connection with FIGS. 1 and 2. The openings in the side wall can be provided with doors or panels allowing said openings to be closed, except when access is needed, for example, in relation to maintenance work and in relation to the replacement of pattern plates. The machine is placed on a floor 300.

Attached to the side 101 of the machine structure is a robot arm 6 for replacing the pattern plates 200. Such pattern plates are typically transported on a carriage like the carriage 201 shown in FIG. 4, which can typically accommodate four pattern plates, that is, it can have capacity to deliver two new plates to be used in future operations for mould production, and to receive the two previously used pattern plates.

The robot arm has a proximal end 6' which is attached to the side wall of the machine. Obviously, the arm does not have to be physically attached to the side wall as such, but it can alternatively be attached to other parts or components of the machine structure, such as to part of the framework of the machine, for example, in correspondence with an opening in the side wall, housing or enclosure of the machine. The arm also has a distal end 6", provided with means 65 for retaining a pattern plate, such as gripping means as schematically illustrated in FIGS. 5 and 6, in the form of, for example, hooks or other kinds of grippers, including mechanically, electrically, pneumatically and hydraulically driven gripping means, including electromagnetical gripping means.

Figure 5:
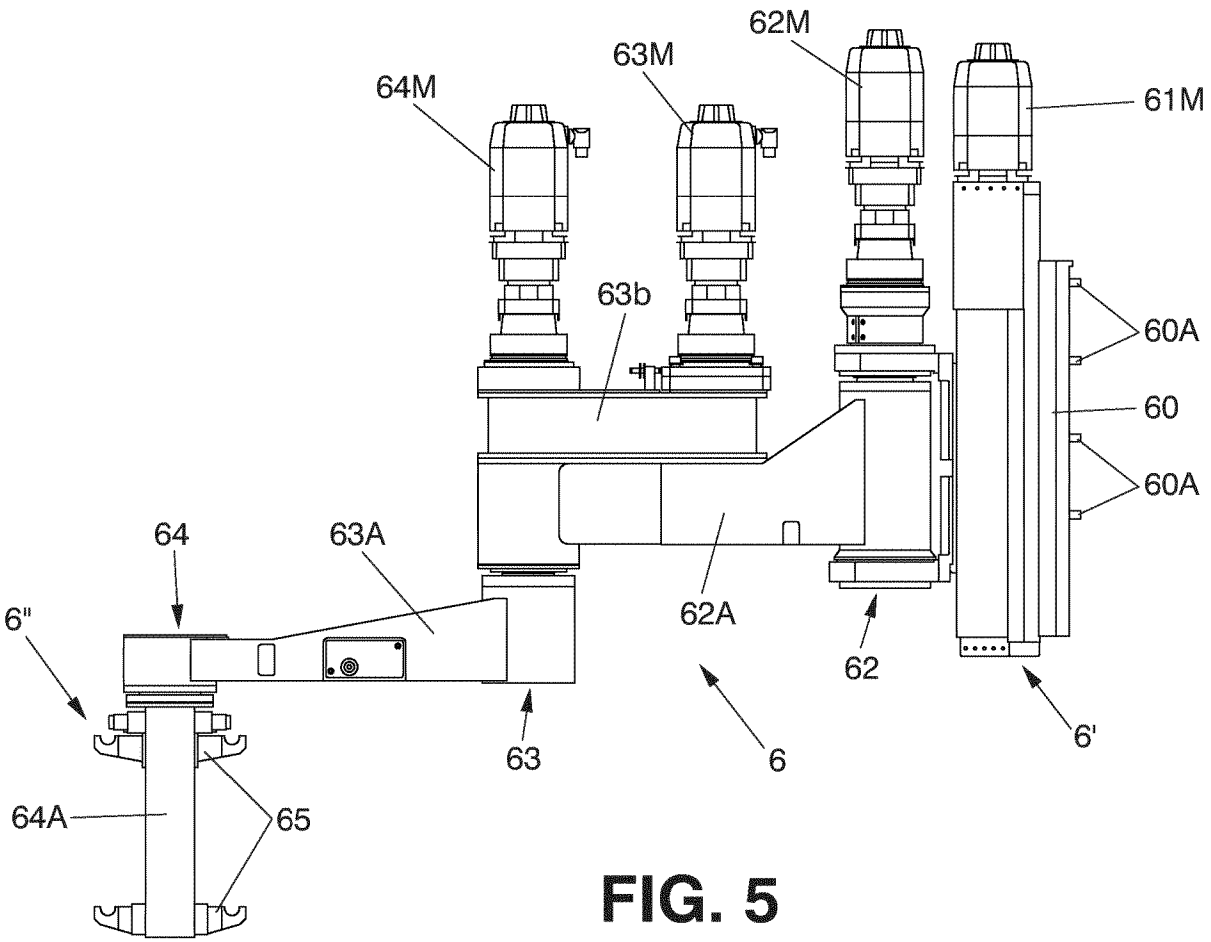
FIG. 5 is a side view of the robot arm.
Figure 6:
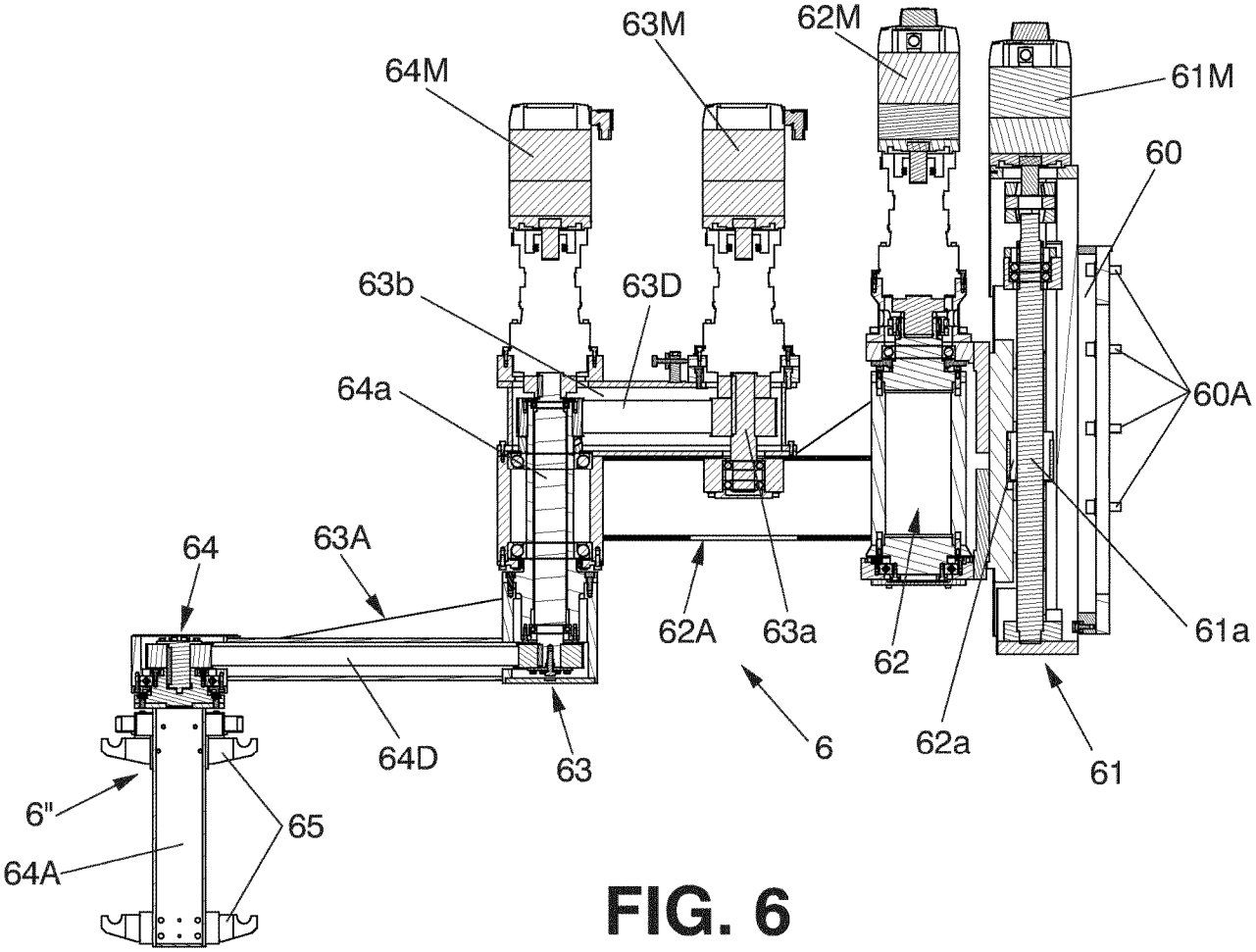
FIG. 6 schematically illustrates the construction of the robot arm.

At its proximal end 6', the robot arm is provided with drive means 61 for displacing the robot arm vertically, in relation to a base 60 by means of which it is fixed to the side 101 of the machine structure, for example, by means of bolts 60A, as illustrated in FIGS. 5 and 6. These drive means are actuated by a first electric motor 61M, such as a servomotor. On the other hand, the robot arm comprises three arm segments, that is, arm segments 62A, 63A and 64A, including the distal arm segment 64A, an intermediate arm segment 63A and a proximal arm segment 62A. The distal arm segment 64A is the one that is provided with the means 65 for retaining the pattern plate. The arm segments are pivotally arranged so that they can pivot in the horizontal plane, by means of corresponding pivot joints 62, 63 and 64. Three electric motors 62M, 63M and 64M are provided, to drive the respective arm segments to pivot around the corresponding vertical axes defined by their corresponding pivot joints 62, 63 and 64.

As best shown in FIG. 6, the vertical drive means 61 comprises a servomotor 61M arranged to drive a threaded spindle 61*a*, to which the proximal pivot joint 62 is connected by means of a threaded nut or similar 62*a*, which is displaced upwards or downwards by the electric motor 61 rotating said spindle 61*a*. On the other hand, an electric motor 62M for operating the proximal pivot joint 62 to pivot the proximal arm segment 62A in the horizontal plane is arranged on top of the proximal pivot joint. On top of the proximal arm segment 62A there is another electric motor 63, arranged to drive the intermediate joint 63 so as to pivot the intermediate arm segment 63A in the horizontal plane, with respect to said intermediate joint 63. This is achieved by means of a drive means 63D such as a chain, belt or shaft, that extends within a housing 63*a* mounted on top of the proximal arm segment 62A. This drive means 63D, such as a belt, chain or shaft, is driven by a shaft 63*b* of the electric motor 63.

A further electric motor 64M is placed on top of the intermediate joint 63 and an output shaft 64*a* of said electric motor 64M drives a drive means 64D such as a chain, belt or shaft housed within and extending throughout the intermediate arm segment 63A, so as to drive the distal joint 64 in order to pivot the distal arm segment 64A in the horizontal plane.

The electric motors can be motors such as servomotors.

By means of this simple arrangement, the robot arm can be remove pattern plates 200 from the first plate 1 and the second plate 2 of the machine, and deliver new pattern plates to said first plate 1 and second plate 2, through the opening 103 in the side of the machine. It has been found that this kind of simple robot arm in practice is capable of carrying out the movements necessary to replace pattern plates, and that there is no need for additional joints or degrees of freedom of movement. The fact that no motor is placed on top of the distal joint is advantageous, in that it reduces the height of the part of the robot arm that is to be introduced into the moulding chamber 3 through the opening 103. The fact that the robot arm is attached to a wall of the machine structure or housing, such as to the framework of the machine, without being placed on the floor, simplifies tasks such as cleaning of the floor. Thus, a compact and attracted layout of the machine is achieved.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

What is claimed is:

1. A machine for the production of sand moulds comprising:

a machine structure with a moulding chamber, a front plate and a rear plate, said front plate and rear plate being arranged for pressing sand within said moulding chamber so as to form a sand mould, said front plate and rear plate being arranged for receiving respective pattern plates for providing front and rear surfaces of the sand mould with corresponding patterns, the machine further comprising a robot arm arranged for replacing the pattern plates, said robot arm being attached to the machine structure;

wherein the robot arm comprises vertical drive means for displacing the robot arm vertically, and three pivot joints for pivoting three corresponding arm segments around corresponding vertical axes;

wherein said robot arm comprising an electric motor for driving the robot arm vertically, and three electric motors each arranged for driving a corresponding one of said three arm segments to pivot with respect to the corresponding pivot joint; and wherein said robot arm has a proximal end at which it is attached to the machine structure, and a distal end which is provided with means for retaining a pattern plate, and wherein said pivot joints comprise a proximal joint, an intermediate joint and a distal joint, said distal joint being arranged for pivoting a distal arm segment with respect to an intermediate arm segment, wherein the electric motor arranged for operating said distal joint is placed away from said distal joint, and wherein said robot arm comprises drive means placed within said intermediate arm segment so that said electric motor arranged for operating said distal joint can operate said distal joint through said intermediate arm segment, to pivot said distal arm segment with respect to said distal joint.

2. The machine according to claim 1, wherein said electric motor for operating said distal joint is placed in correspondence with said intermediate joint.

3. The machine according to claim 2, wherein said electric motor for operating said distal joint is arranged for operating said distal joint by means of at least one of a chain, a belt and a drive shaft extending throughout said intermediate arm segment.

4. A machine for the production of sand moulds comprising:

a machine structure with a moulding chamber, a front plate and a rear plate, said front plate and rear plate being arranged for pressing sand within said moulding chamber so as to form a sand mould, said front plate and rear plate being arranged for receiving respective pattern plates for providing front and rear surfaces of the sand mould with corresponding patterns, the machine further comprising a robot arm arranged for replacing the pattern plates, said robot arm being attached to the machine structure;

wherein said robot arm is attached to a side of the machine structure;

wherein the robot arm comprises vertical drive means for displacing the robot arm vertically, and three pivot joints for pivoting three corresponding arm segments around corresponding vertical axes;

wherein said robot arm comprising an electric motor for driving the robot arm vertically, and three electric motors each arranged for driving a corresponding one of said three arm segments to pivot with respect to the corresponding pivot joint; and wherein said robot arm has a proximal end at which it is attached to the machine structure, and a distal end which is provided with means for retaining a pattern plate, and wherein said pivot joints comprise a proximal joint, an intermediate joint and a distal joint, said distal joint being arranged for pivoting a distal arm segment with respect to an intermediate arm segment, wherein the electric motor arranged for operating said distal joint is placed away from said distal joint, and wherein said robot arm comprises drive means placed within said intermediate arm segment so that said electric motor arranged for operating said distal joint can operate said distal joint through said intermediate arm segment, to pivot said distal arm segment with respect to said distal joint.

5. The machine according to claim 4, wherein said electric motor for operating said distal joint is placed in correspondence with said intermediate joint.

6. The machine according to claim 5, wherein said electric motor for operating said distal joint is arranged for operating said distal joint by means of at least one of a chain, a belt and a drive shaft extending throughout said intermediate arm segment.

7. A machine for the production of sand moulds comprising:

a machine structure with a moulding chamber, a front plate and a rear plate, said front plate and rear plate being arranged for pressing sand within said moulding chamber so as to form a sand mould, said front plate and rear plate being arranged for receiving respective pattern plates for providing front and rear surfaces of the sand mould with corresponding patterns, the machine further comprising a robot arm arranged for replacing the pattern plates, said robot arm being attached to the machine structure;

wherein the machine is placed on a floor and wherein said robot arm is attached to the machine structure above the floor, so that no part of the robot arm is in contact with the floor;

wherein the robot arm comprises vertical drive means for displacing the robot arm vertically, and three pivot joints for pivoting three corresponding arm segments around corresponding vertical axes;

said robot arm comprising an electric motor for driving the robot arm vertically, and three electric motors each arranged for driving a corresponding one of said three arm segments to pivot with respect to the corresponding pivot joint; and wherein said robot arm has a proximal end at which it is attached to the machine structure, and a distal end which is provided with means for retaining a pattern plate, and wherein said pivot joints comprise a proximal joint, an intermediate joint and a distal joint, said distal joint being arranged for pivoting a distal arm segment with respect to an intermediate arm segment, wherein the electric motor arranged for operating said distal joint is placed away from said distal joint, and wherein said robot arm comprises drive means placed within said intermediate arm segment so that said electric motor arranged for operating said distal joint can operate said distal joint through said intermediate arm segment, to pivot said distal arm segment with respect to said distal joint.

8. The machine according to claim 7, wherein said electric motor for operating said distal joint is placed in correspondence with said intermediate joint.

9. The machine according to claim 8, wherein said electric motor for operating said distal joint is arranged for operating said distal joint by means of at least one of a chain, a belt and a drive shaft extending throughout said intermediate arm segment.

* * * * *